US010894002B2

(12) United States Patent
Hamilton

(10) Patent No.: US 10,894,002 B2
(45) Date of Patent: Jan. 19, 2021

(54) SYSTEMS, DEVICES, AND/OR METHODS FOR MANAGING MEDICAMENTS

(71) Applicant: Joseph Hamilton, Afton, VA (US)

(72) Inventor: Joseph Hamilton, Afton, VA (US)

( * ) Notice: Subject to any disclaimer, the term of this patent is extended or adjusted under 35 U.S.C. 154(b) by 116 days.

(21) Appl. No.: 16/015,082

(22) Filed: Jun. 21, 2018

(65) Prior Publication Data

US 2019/0105233 A1 Apr. 11, 2019

Related U.S. Application Data

(60) Provisional application No. 62/527,064, filed on Jun. 30, 2017.

(51) Int. Cl.

| | |
|---|---|
| ***A61J 1/03*** | (2006.01) |
| ***A61J 7/00*** | (2006.01) |
| ***A61J 7/04*** | (2006.01) |

(52) U.S. Cl.

CPC ..... *A61J 7/0076* (2013.01); *A61J 1/03* (2013.01); *A61J 7/0418* (2015.05); *A61J 7/0436* (2015.05); *A61J 7/0472* (2013.01); *A61J 7/0481* (2013.01); *A61J 2200/30* (2013.01); *A61J 2200/70* (2013.01); *A61J 2205/40* (2013.01)

(58) Field of Classification Search

CPC ... A61J 7/0084; A61J 7/0409; B65D 83/0409; B65D 83/04

USPC ..... 700/236

See application file for complete search history.

(56) References Cited

U.S. PATENT DOCUMENTS

| | | | | |
|---|---|---|---|---|
| 3,612,348 | A * | 10/1971 | Thomas | A61J 7/04 221/2 |
| 7,073,685 | B1 * | 7/2006 | Giraud | B65D 83/0409 221/260 |
| 7,988,016 | B2 * | 8/2011 | Klein | B65D 83/0409 221/1 |
| 8,727,180 | B2 * | 5/2014 | Zonana | A61J 7/0409 221/241 |
| 2007/0007301 | A1 * | 1/2007 | Kaplan | G07F 11/00 221/288 |
| 2009/0120953 | A1 * | 5/2009 | Erdelyi | B65D 83/0409 221/259 |
| 2011/0060457 | A1 * | 3/2011 | De Vrught | A61J 1/03 700/241 |
| 2012/0223091 | A1 * | 9/2012 | Bond | A61J 7/02 221/7 |
| 2013/0116818 | A1 * | 5/2013 | Hamilton | A61J 7/04 700/236 |
| 2013/0256331 | A1 * | 10/2013 | Giraud | A61J 1/03 221/1 |
| 2015/0076170 | A1 * | 3/2015 | Goettke | B65D 83/0409 221/250 |
| 2017/0079887 | A1 * | 3/2017 | Song | B65D 83/0409 |
| 2017/0231871 | A1 * | 8/2017 | Aldasouqi | A61J 7/0084 221/203 |
| 2018/0229918 | A1 * | 8/2018 | Petit | A61J 7/0053 |

*Primary Examiner* — Gene O Crawford

*Assistant Examiner* — Ayodeji T Ojofeitmi

(74) *Attorney, Agent, or Firm* — Dale Jensen, PLC; Dale Jensen

(57) ABSTRACT

Certain exemplary embodiments can provide a device, which can comprise a pill reservoir, a first layer, and a chamber. The first layer comprises an inclined entry passage open to the pill reservoir and an exit passage open to a dispense passage. A portion of the chamber layer can travel linearly in close communication within a tubular shaped portion of the first layer.

12 Claims, 24 Drawing Sheets

1000

1000

1000

1000

1000

1000

1000

1000

1000

1000

1000

1000

1000

1000

SYSTEMS, DEVICES, AND/OR METHODS FOR MANAGING MEDICAMENTS

CROSS-REFERENCES TO RELATED APPLICATIONS

This application claims priority to, and incorporates by reference herein in its entirety, U.S. Provisional Patent Application Ser. No. 62/527,064, filed Jun. 30, 2017.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Figures 1A, 1B, 1C:
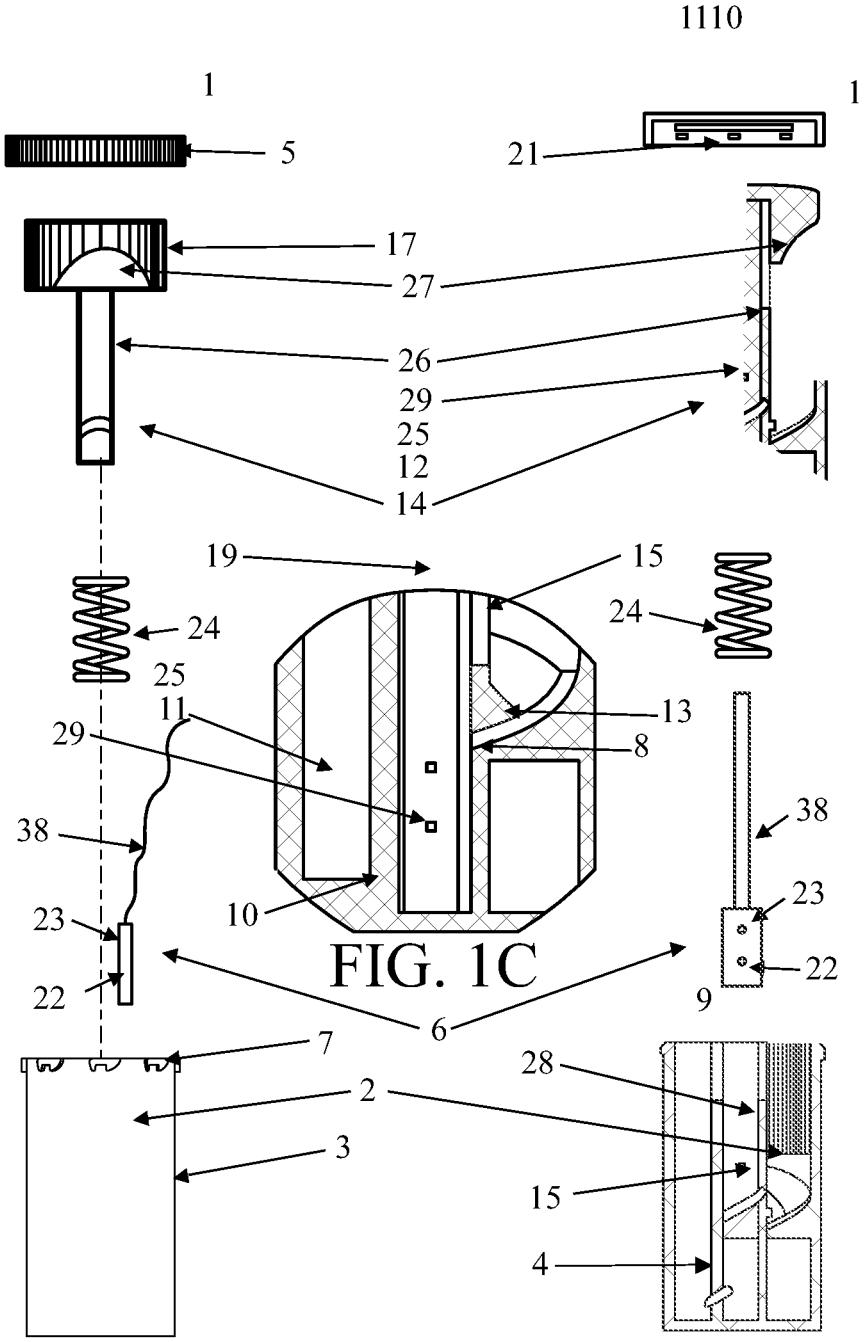
FIG. 1A illustrates an exploded view of an example pill dispensing assembly for dispensing pills from a pill bottle.
FIG. 1B illustrates another angle of an exploded view cut away of an example pill dispensing assembly for dispensing pills from a pill bottle.
FIG. 1C illustrates a close up cut away view of the lower region of an example pill dispensing assembly for dispensing pills from a pill bottle.

Certain exemplary embodiments can provide a device, which can comprise a pill reservoir, a first layer, and a chamber layer. The first layer comprises an inclined entry passage open to the pill reservoir and an exit passage open to a dispense passage. A portion of the chamber layer can travel linearly in close communication within a tubular shaped portion of the first layer.

Certain exemplary embodiments provide medicament dispensers, which can dispense one pill at a time and/or collect dose timing information for each pill dispensed. Certain exemplary embodiments provide a device comprising operational and/or mechanical parts resembling a bottle in outside appearance and/or size. Certain exemplary embodiments can have a size and dimensions and/or have a similar look as commonly used by pharmacies to fill prescription medication and where the seal provided by a typical child and/or moisture proof cap is all that is required to make certain exemplary embodiments substantially child and/or moisture proof.

Certain exemplary embodiments provide a pill dispensing assembly constructed for dispensing, controlling, and/or monitoring the dispensing of pills. According to one exemplary embodiment, a pill dispensing assembly constructed for dispensing a pill from a pill bottle comprises a first layer that comprises an inclined entry passage open to a pill reservoir and an exit passage open to a dispense passage. The pill dispensing assembly comprises a chamber layer whereby a portion of the chamber layer travels linearly in close communication within a tubular shaped portion of the first layer, and comprises an inclined pill holding chamber sized to receive a pill from a pill reservoir. The chamber layer is biased by a first bias member (e.g., a spring) to the first loading position whereby the pill holding chamber is aligned with the entry passage of the first layer, which is offset from the exit passage. The chamber layer is linearly movable in opposition to the first bias member to a first dispense position whereby the pill holding chamber is aligned with the exit passage of the first layer.

Another exemplary embodiment provides a pill dispensing assembly constructed for dispensing a pill from a pill reservoir, which pill dispensing assembly comprises a first layer that comprises an inclined entry passage open to the pill reservoir and an exit passage open to a dispense passage. The pill dispensing assembly comprises a chamber layer. The chamber layer comprises an upper portion and a lower portion. A portion of the upper portion of the chamber layer travels linearly in close communication within a portion of the first layer and is biased apart linearly from the lower portion of the chamber layer by a second bias member. The lower portion of the chamber layer travels linearly in close communication with a portion of the first layer and is biased apart linearly from the upper portion of the chamber layer by a second bias member (e.g., a spring), and comprises an inclined pill holding chamber sized to receive a pill from a pill reservoir. The lower portion of the chamber layer is biased by a first bias member (e.g., a spring) to a first loading position whereby the pill holding chamber is aligned with the entry passage of the first layer which is offset from the exit passage and where the chamber layer is linearly movable in opposition to the first bias member to a first dispense position whereby the pill holding chamber is aligned with the exit passage of the first layer. The upper portion of the chamber layer may move linearly and compress the second bias member allowing the lower portion of the chamber layer to remain linearly stationary with respect to the first layer in the event the lower portion of the chamber layer encounters an obstruction (e.g., misaligned pills).

In certain exemplary embodiments, a controller may be used to record prescription information and/or timing information related to pill dispensing.

To operate certain exemplary pill dispensing assemblies herein, the user can perform one or more activities of the following method: while the pill dispensing assembly is in upright orientation, the user can remove a child and/or moisture proof cap. While pill dispensing assembly is in an upright orientation the user pushes down on the top surface of the chamber layer to a fully depressed position. Gravity causes the pill to move out of the ramp feature of the holding chamber and exit passage in first layer. The user releases the chamber layer. The user then inverts the pill dispensing assembly to deliver pill external to the pill dispensing assembly via the dispense passage. This process is repeated according to the prescribed schedule for each pill contained within the pill reservoir.

COMPONENT LIST

Pill Dispensing Assembly (1)
Pill Reservoir (2)
First Layer (3)
Chamber Layer (4)
Child and/or Moisture Proof Cap (5)
Controller Circuit (6)
Cap Catches (7)
Entry Passage (8)
Housing Element (9)
Exit Passage (10)
Dispense Passage (11)
Holding Chamber (12)
Blocking Protrusion (13)
Chamber Extension (14)
First Catch Slot (15)
First Cap Grooves (16)
Push Button Top (17)
Second Cap Grooves (18)
First Housing Grooves (19)
First Chamber Grooves (20)
Cap Locking Members (21)
First Sensor (22)
Second Sensor (23)
First Bias Member (24)
First Through Hole (25)
First Catch (26)
Fill Recess (27)
Second Catch Slot (28)
Second Through Hole (29)
Controller Slot (30)
Chamber Back Light (31)—not shown
Second Pill Dispensing Assembly (32)
Upper Chamber Portion 33
Lower Chamber Portion 34
Second Bias Member (35)
Third Catch (36)
Third Catch Slot (37)
Battery Pull Tab (38)

A first embodiment is illustrated in FIG. 1A through FIG. 3D. FIG. 1A and FIG. 1C illustrates exploded views of a first example pill dispensing assembly 1 for dispensing a pill from a pill reservoir 2, and FIG. 1C illustrates an enlarged image of the lower region of the pill dispensing assembly 1. FIG. 2A through 3D provide additional views to further illustrate the first embodiment. The pill can comprise pharmaceutical solid dose, pill, tablet or gelatin capsules, for example. The pill dispensing assembly 1 comprises a first layer 3, a chamber layer 4, a first bias member 24, a child and/or moisture proof cap 5, and/or a controller circuit 6.

In certain exemplary embodiments provide a device (i.e., pill dispensing assembly 1), which comprises:

- a pill reservoir 2;
- a first layer 3 that comprises an inclined entry passage 8 open to pill reservoir 2 and an exit passage 10 open to a dispense passage 11;
- a chamber layer 4 whereby a portion of chamber layer 4 travels linearly in close communication within a tubular shaped portion of first layer 3, and comprises an inclined pill holding chamber 12 sized to receive a pill from pill reservoir 2; and/or
- a controller circuit 6 constructed to record prescription information and timing information related to pill dispensing, wherein:
  - chamber layer 4 is biased by a first bias member 24 to the first loading position whereby the pill holding chamber is aligned with entry passage 8 of first layer 3 which is offset from exit passage 10; and
  - chamber layer 4 is linearly movable in opposition to first bias member 24 to a first dispense position whereby pill holding chamber 12 is aligned with exit passage 10 of first layer 3.

The first layer 3 is a single component that comprises a pill reservoir 2 where a plurality of pharmaceutical solid dose pills may be placed and protected against child access and moisture ingress by attachment of a child and/or moisture proof cap 5 typically used by pharmacies. In this example the pill dispensing assembly 1 is shaped cylindrically with an opening for filling and an array of cap catches 7 used to secure the child and/or moisture proof cap 5. The bottom surface of the pill reservoir 2 is configured to be sloped and dimensioned to facilitate progression and alignment of pill into the chamber layer 4 through the entry passage 8 in the linearly aligned tubular housing element 9 of the first layer 3.

First layer 3 comprises an entry passage 8 that is offset from the exit passage 10 with respect to a horizontal axis and opposite to the exit passage 10 with respect to a vertical axis when pill dispensing assembly 1 is held upright.

The first layer 3 comprises a linearly aligned tubular dispense passage 11 whose upper opening is exposed external to the pill dispensing assembly 1 whenever the child and/or moisture proof cap 5 is removed. The dispense passage 11 is open to the inside of the housing element 9 by an exit passage 10 which allows a pill to move between the holding chamber 12 and the dispense passage 11 when aligned.

The first layer 3 comprises an integral blocking protrusion 13 that extends into the pill reservoir 2 and is located above and in close proximity to the entry passage 8 and serves to help prevent pill blockage around the entry passage 8 by preventing downward pressure from pills congested above and about the entry passage 8.

The chamber layer 4 can be a single component that comprises a push button top 17 with an elongated chamber extension 14 that fits within and in close communication with the housing element 9 and is linearly movable to the extent allowed by a vertical length of the first catch slot 15 and the first catch 26 which travels linearly within the first catch slot 15. The chamber layer 4 comprises a holding chamber 12 which may be configured and dimensioned to guide and accept entry of a pill either on its flat or long axis (e.g. may allow round and flat type pill to roll in as car tire on a road). The holding chamber 12 may be configured with a profile as to act as a general continuation to that of the ramped/guide feature of the bottom surface of the pill reservoir 2.

A portion of the top inward facing surface of the pill reservoir 2 comprises an array of linearly aligned first cap grooves 16. The push button top 17 portion of chamber layer 4 is configured with an array of linearly aligned second cap grooves 18 around the outward face of the push button top 17 which closely mesh with the first cap grooves 16. The undulating and closely matting surfaces of the first cap grooves 16 and the second cap grooves 18 forms a substantially impenetrable barrier to tampering, for example, by a foreign object inserted into the assembly while allowing the chamber layer 4 to move from loading to dispensing position and vice versa while maintaining the substantially impenetrable and tamper resistant joint. Other tamper resistant features could be added internal to the pill reservoir 2; for example, a ridge could be added around the internal surface of the pill reservoir 2 below the lower travel zone of the push button top 17 to act as a blocking mechanism to inserted objects.

A portion of the inner surface of the housing element 9 comprises an array of linearly aligned first housing grooves 19. A portion of the external face of the chamber extension 14 is configured with an array of linearly aligned first chamber grooves 20 which closely communicate and mesh with the first housing grooves 19. The undulating and closely matting surfaces of the first housing grooves 19 and the first chamber grooves 20 forms and maintains a substantially impenetrable and tamper resistant joint.

The pill dispensing assembly 1 can be sealed using a child and/or moisture proof cap 5 design commonly used by pharmacies. The child and/or moisture proof cap 5 which comprises a flexible sealing diaphragm may be secured to the pill dispensing assembly 1 via catches internal to the child and/or moisture proof cap 5 and corresponding cap locking members 21.

There are four different operating positions that define the basic operation of the pill dispensing assembly 1. These four operating positions comprise the cap on position (FIG. 2E), load position (FIGS. 2B, 2D, 2G, 3C), dispense position (FIGS. 2C, 2H, 3D) and transition position. The first layer 3 and all its elements can be fixed; therefore, the four different operating positions are primarily defined by the linear orientation of the chamber layer 4, in relation to the elements of the first layer 3. Furthermore, as will be discussed below, movement between the load and dispensing positions can be monitored so that pill providers and other parties of interest (e.g. doctors, law enforcement, monitoring agencies) may detect pre-addiction dosing patterns or diversion, and take appropriate action to prevent future abuse.

Figure 2A:
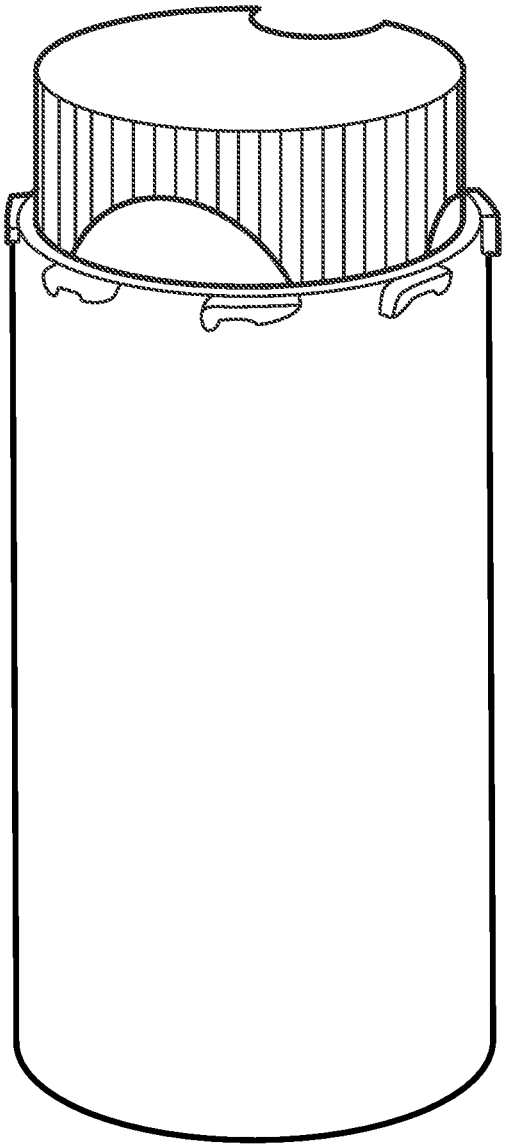
FIG. 2A illustrates an assembled view of the pill dispensing assembly in the optional pharmacy fill position.
Figure 2B:
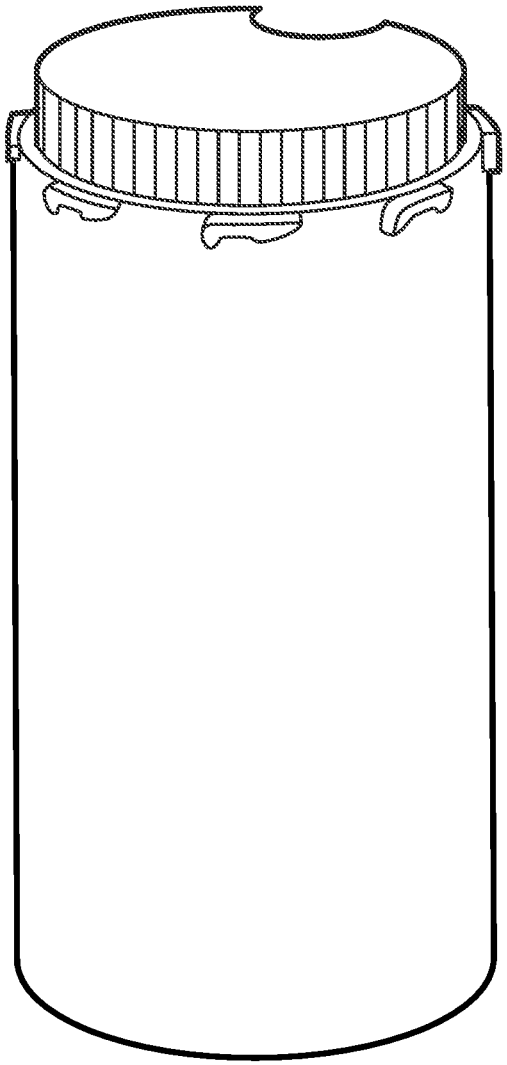
FIG. 2B illustrates an assembled cut view of the pill dispensing assembly in the load position.
Figure 2C:
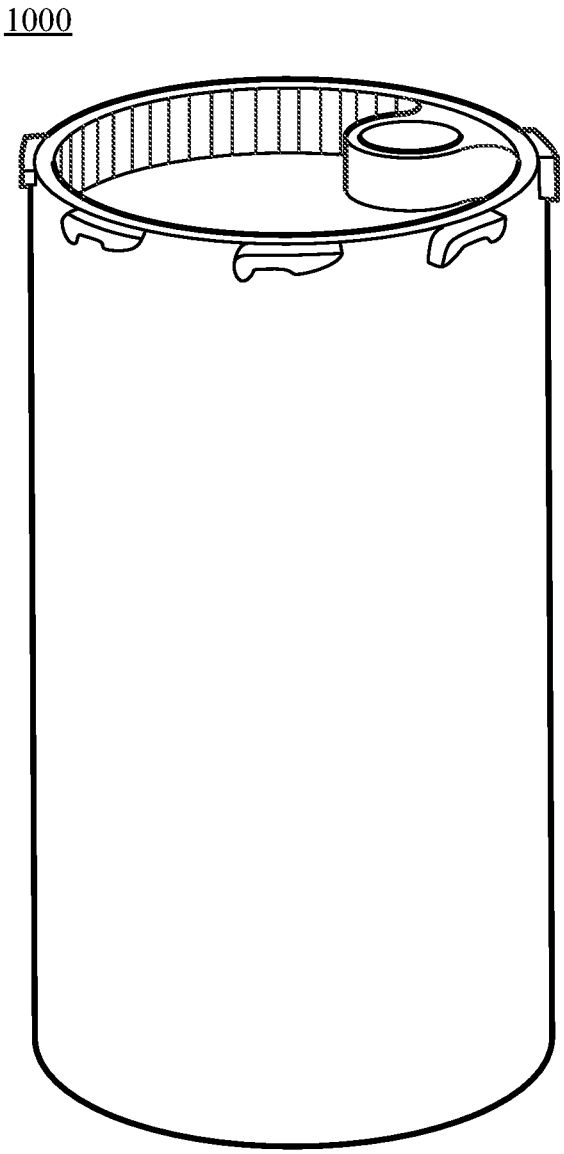
FIG. 2C illustrates an assembled view of the pill dispensing assembly in the dispense position.
Figure 2D:
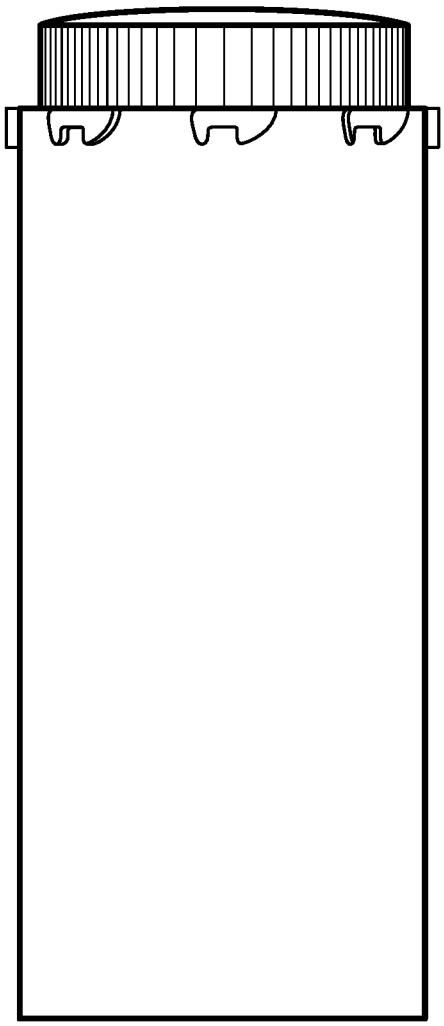
FIG. 2D illustrates an assembled side view of the pill dispensing assembly in the cap off position; also the load position.
Figure 2E:
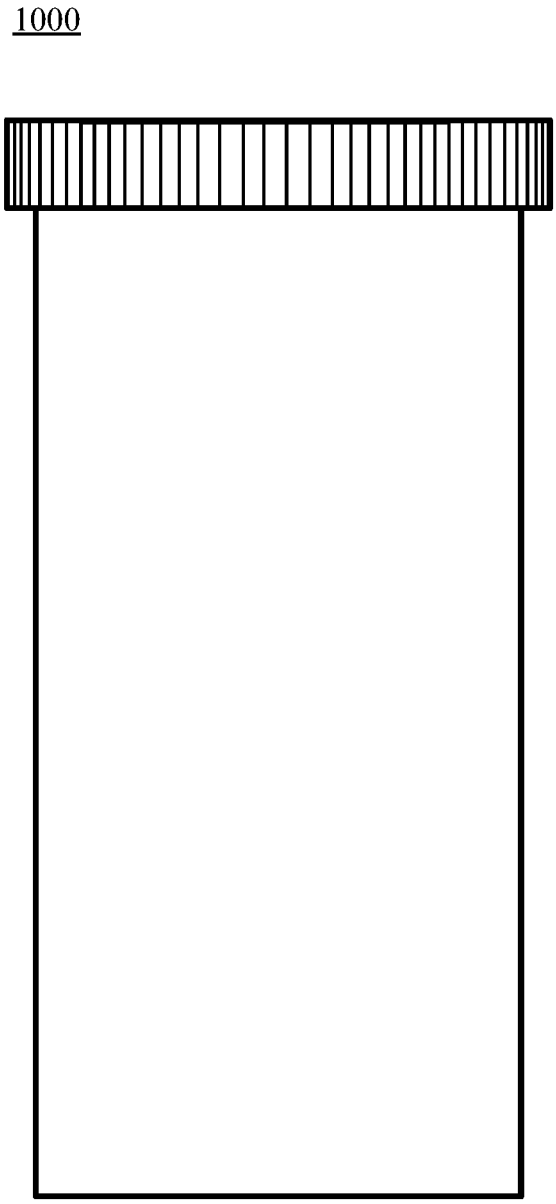
FIG. 2E illustrates an assembled side view of the pill dispensing assembly in the cap on position.

The cap on position occurs when the child and/or moisture proof cap 5 is attached as a closure to the pill dispensing assembly 1 as depicted in FIG. 2E. Attachment of the child and/or moisture proof cap 5 pushes the chamber layer 4 linearly from the default load position. This displacement causes first sensor 22 and second sensor 23 to align and detect regions of the chamber layer 4 which are solid and distinguishable by sensor from other detectable features thereby allowing the controller circuit to know that the pill dispensing assembly 1 is located at either the load position, transition position or the dispense position. At the cap on position the controller may enter a sleep mode needing only to monitor for sensor transitional states to detect removal of the child and/or moisture proof cap 5 and thereby start monitoring sensor input indicative of pill dispensing activities.

The load position occurs when the child and/or moisture proof cap 5 is removed and the first bias member 24 returns the chamber layer 4 to its upper vertical orientation as depicted in FIGS. 2B, 2D, 2G, 3C. This upper most vertical orientation of the chamber layer 4 during normal operation is configured such that the holding chamber 12 is horizontally aligned with the entry passage 8 and horizontally offset from the exit passage 10. In this position a pill can enter the holding chamber 12 from the pill reservoir 2. A pill in the holding chamber 12 can be detected by a controller circuit 6 via a first sensor 22 linearly aligned with holding chamber 12. In this embodiment, the sensor may be light based; therefore, there is a first through hole 25 in the chamber layer 4 at the holding chamber 12 to allow sensor access to detect if a pill is in the holding chamber 12 and if the chamber layer 4 is in the load position. An empty holding chamber 12, pill in holding chamber 12 and holding chamber not aligned with the first through hole 25 each exhibit a different detectable profile allowing the detection of either of these three states with as few as a single sensor.

Figure 2F:
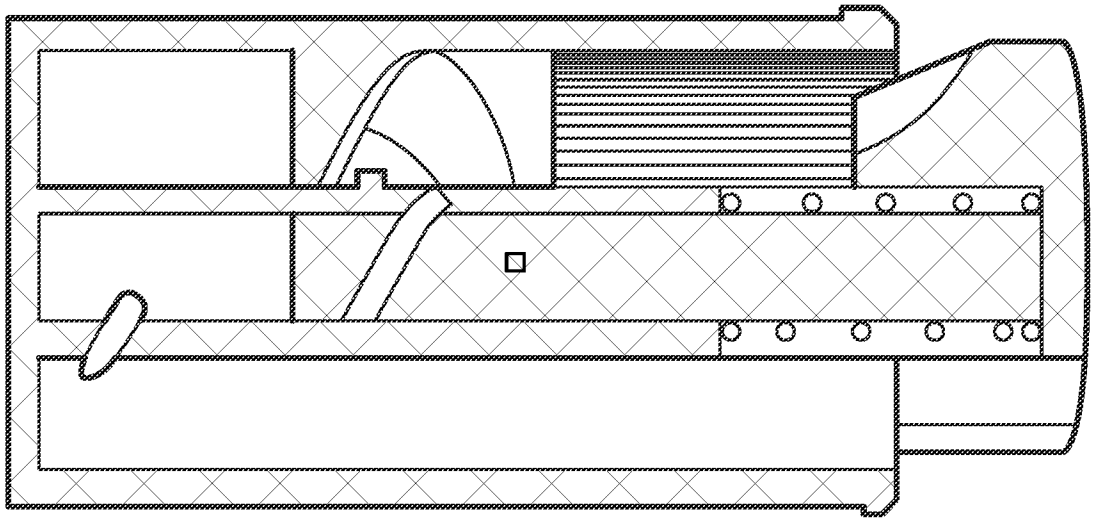
FIG. 2F illustrates an assembled side view of the pill dispensing assembly in the cap on position.
Figure 2G:
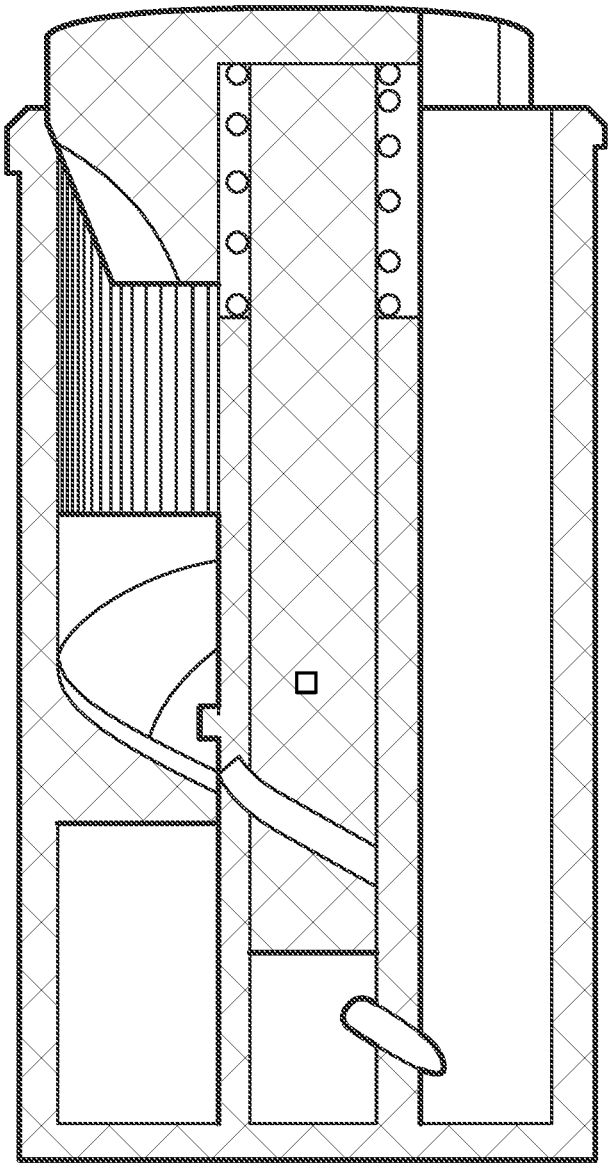
FIG. 2G illustrates an assembled side cut away view of the pill dispensing assembly in the load position.
Figure 2H:
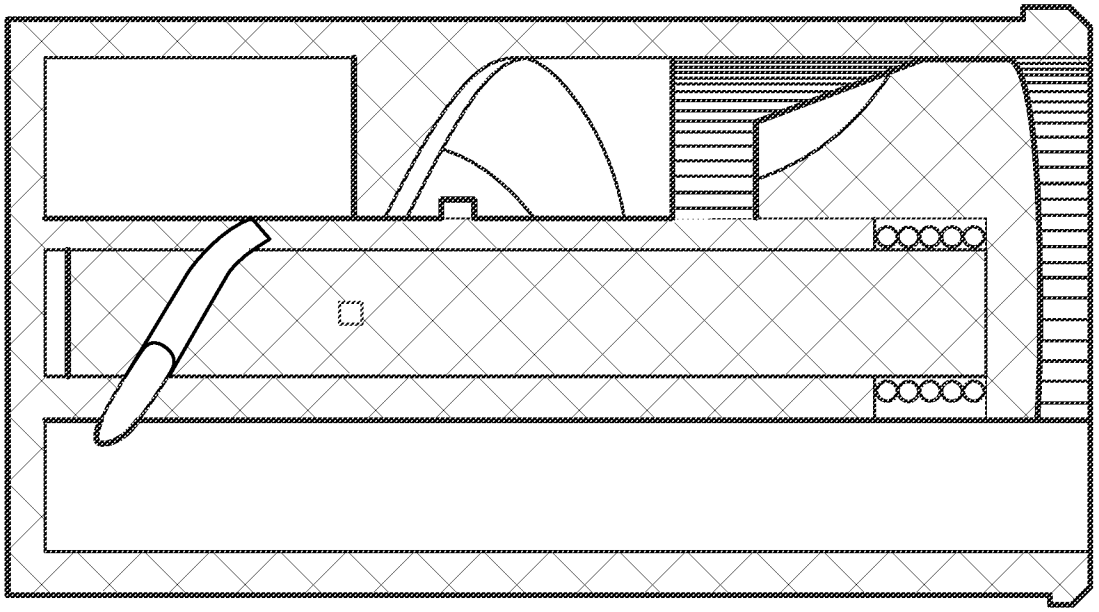
FIG. 2H illustrates an assembled side cut away view of the pill dispensing assembly in the dispense position.
Figure 3A:
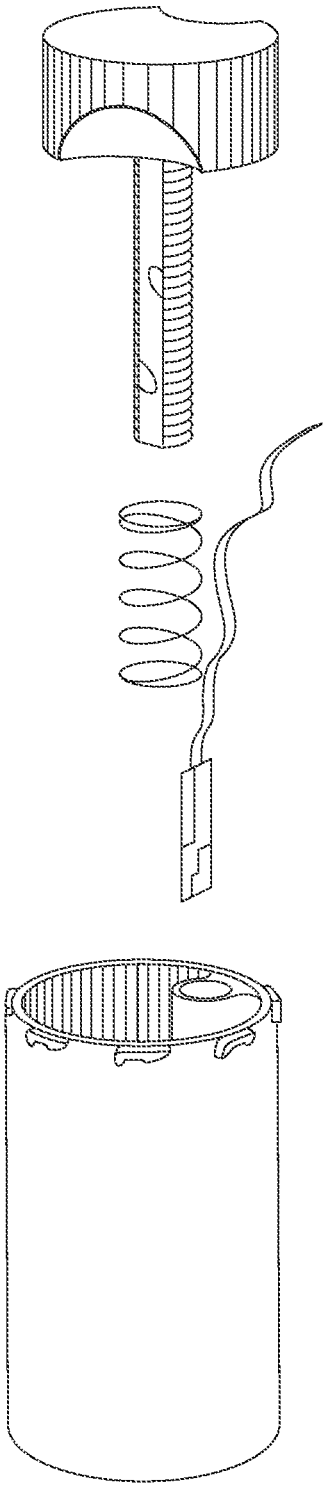
FIG. 3A illustrates an exploded angled view of an example pill dispensing assembly for dispensing pills from a pill bottle.
Figure 3B:
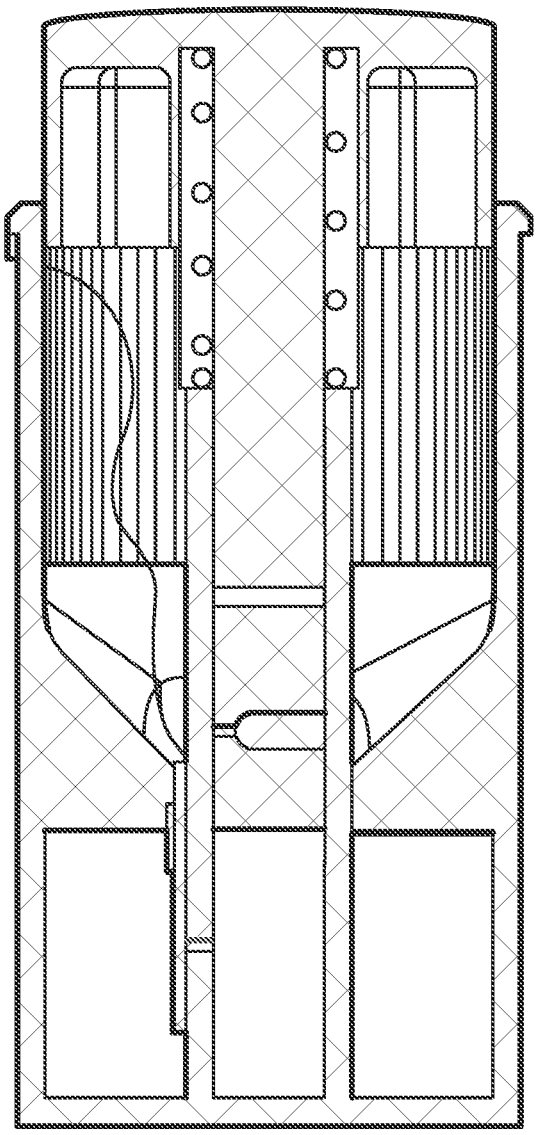
FIG. 3B illustrates an assembled side cut away view of an example pill dispensing assembly for dispensing pills from a pill bottle at the pharmacy fill position.
Figure 3C:
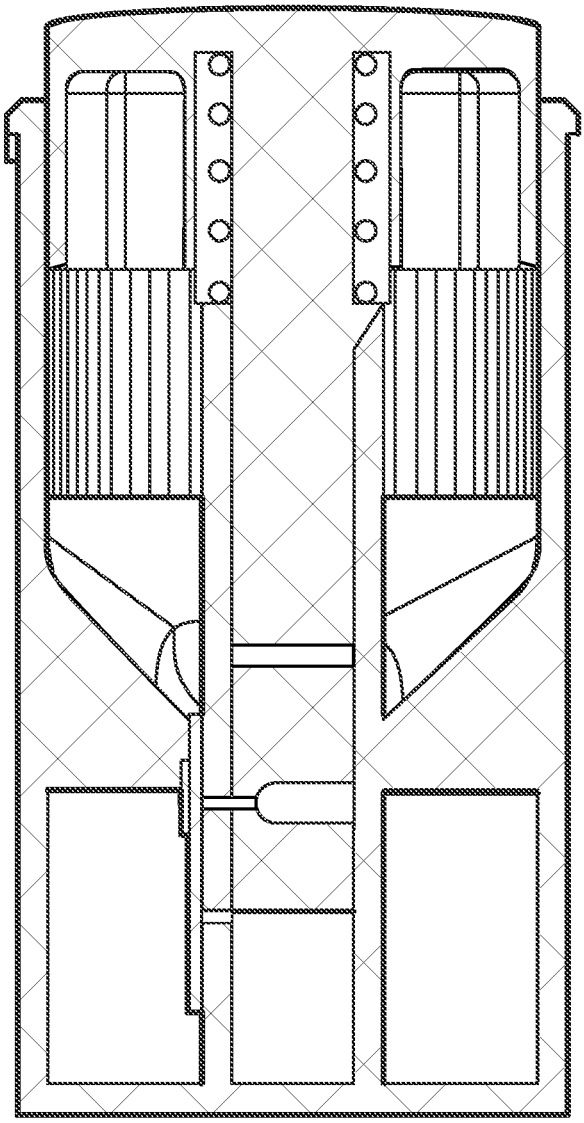
FIG. 3C illustrates an assembled side cut away view of an example pill dispensing assembly for dispensing pills from a pill bottle at the load position.
Figure 3D:
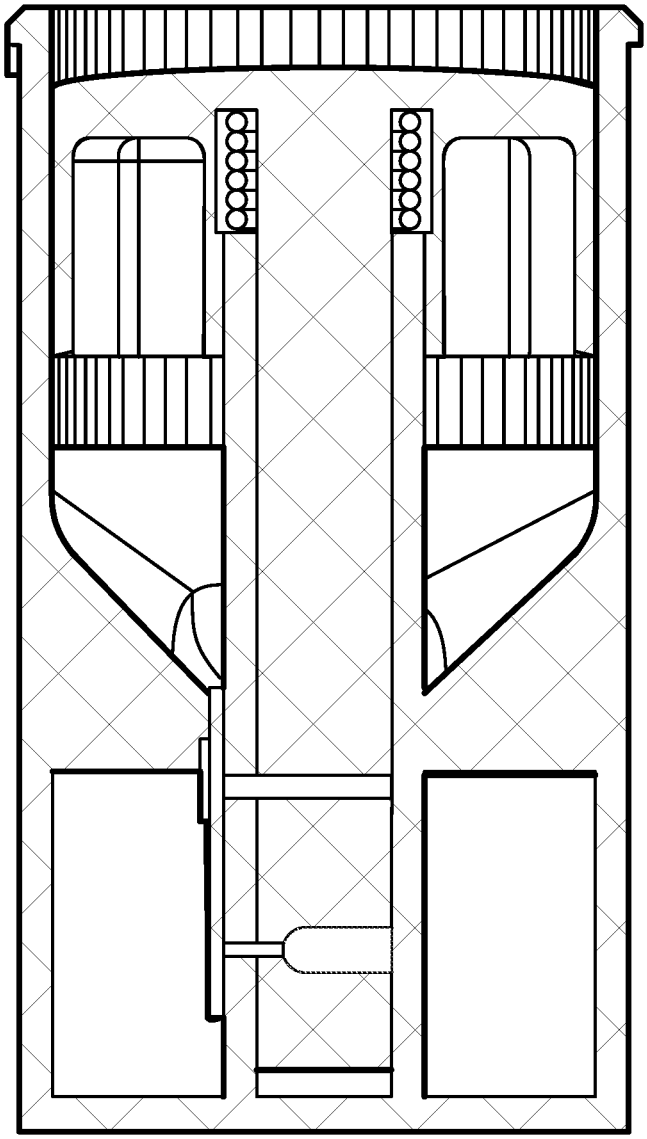
FIG. 3D illustrates an assembled side cut away view of an example pill dispensing assembly for dispensing pills from a pill bottle at the pharmacy dispense position.

The dispense position occurs when the chamber layer 4 is depressed to its lowest vertical orientation as depicted in FIGS. 2C, 2H, 3D. This lowest vertical orientation of the chamber layer 4 is configured such that the holding chamber 12 is horizontally aligned with the exit passage 10 and horizontally offset from the entry passage 8. In this position a pill may exit the holding chamber 12 and enter the dispense passage 11 to be dispensed external to the device. The dispense position is detected by the controller circuit 6 via the first sensor 22 horizontally aligned with the first through hole 25 and the second sensor 23 aligned with the second through hole 29. In this embodiment, the sensors may be light based; therefore, able to sense detectable features of the chamber layer 4 or first layer through holes in the chamber layer 4. The leading edge of the dispense position is detected and associated timestamp is recorded and stored in memory by controller circuit 6 denoting that a pill has been dispensed. In certain exemplary embodiments, controller circuit 6 can be constructed to detect if a pill is in pill holding chamber 12 and record a timestamp denoting that the pill has been dispensed The transition position can occur between the period where the controller circuit 6 and associated program logic detects the load position and dispense positions. This point of detection is configured to occur between the load position and the dispense position as the chamber layer 4 is depressed beyond the load position and prior to reaching the dispense position. At this point of operation, the holding chamber 12 is both horizontally offset from the entry passage 8 and horizontally offset from the exit passage 10 and the pill is prevented from entering either the entry passage 8 or the exit passage 10. During this transition period of vertical travel, the pill should be retained within the holding chamber 12 and the presence of the pill is detectable by second sensor 23 as the first through hole 25 aligns with the second sensor 23. Once this transition position is detected by the controller circuit 6 and associated program logic, it will know if a tablet has been secured in the holding chamber 12 or not. If the chamber layer 4 travels from the load position to the dispense position without detecting a pill in the holding chamber 12, the controller circuit 6 can determine that no pill was retained in the holding chamber 12 in the transition position and that no pill was dispensed even though the dispense position was by reached. Detecting whether a pill is in the holding chamber 12 in the transition position prevents the pill dispensing assembly 1 from falsely recording a dispensing operation when no pill was dispensed. In certain exemplary embodiments, controller circuit 6 is constructed to detect if a pill is in a transition position and thereby prevent a false recording of a dispensing operation when no pill was dispensed.

This embodiment default position is due to configuration of the first bias member 24 is a load position where the holding chamber 12 is aligned to the entry passage 8 that is vertically higher than the exit passage 10 when pill dispensing assembly 1 is in an upright orientation. Of course, this is only an example, and it would also be possible to configure the exit passage 10 vertically higher than the entry passage 8 when pill dispensing assembly 1 is in an upright orientation. In this alternate configuration, the pill will only be allowed to enter the holding chamber 12 when the chamber layer 4 is depressed and upon release of the chamber layer 4, first bias member 24 returns the holding chamber 12 upward to align with the exit passage 10, thus allowing the pill to enter the dispense passage 11.

The pharmacist can fill the pill dispensing assembly 1 by multiple methods. One method is prior to attempting to assemble the first layer 3 with the chamber layer 4. When the first layer 3 and chamber layer 4 are separated or not yet assembled, the top opening of the pill reservoir 2 is open thereby allowing a multitude of pills to be placed inside the pill reservoir 2. The elongated chamber extension 14 may then be inserted into the opening in the top of the housing element 9 and linearly depressed until the first catch 26 flexes outward and is securely retained within the first catch slot 15 thereby delivering the pill dispensing assembly 1 to the load position where the child and/or moisture proof cap 5 may be attached.

In an alternate filling method, the pharmacist may fill the pill dispensing assembly 1 after the first layer 3 and the chamber layer 4 have been partially assembled. The pharmacist may receive the pill dispensing assembly 1 already configured in this orientation. In this partially assemble configuration, the chamber extension 14 will have been inserted into the opening in the top of the housing element 9 and linearly depressed until the first catch 26 flexes outward and is securely retained within the second catch slot 28. In this configuration as shown in FIGS. 2A, 2F the fill recess 27 provides an open passage between the upper lip of the pill reservoir 2 and the push bottom top 17 allowing a plurality of pills to be placed inside the pill reservoir 2. Once the pills have been placed in the pill reservoir 2, the chamber layer 4 may be linearly depressed further downward until the first catch 26 flexes outward and is securely retained within the first catch slot 15 thereby delivering the pill dispensing assembly 1 to the load position where the child and/or moisture proof cap 5 may be attached. Other catch and slot features described herein operate similarly.

The controller circuit 6 can comprise electronic components, which can comprise one or more of a microprocessor, memory, a sensor array, and an input/output ("I/O") device. The microprocessor receives pill and chamber layer 4 positional information from the sensor array and electronically records either the raw data, or information related to the raw data. For example, the microprocessor may simply record in memory the time that chamber layer 4 is positioned where the pills are allowed to exit the holding chamber 12 into the dispense passage 11. As another example, the microprocessor may calculate and record in memory other information relating to pill dispensing, such as a time duration between subsequent pills.

The microprocessor may be operatively connected to the I/O device, which can serve as an output device to receive and transmit recorded pill timing information and/or other pill dosing information to a remote receiver. Throughout this application, the phrase "pill dosing information" can comprise one or more of the following: a dosing non-compliance indication, a pharmacy ID, a pharmacist ID, a patient ID, prescribed drug information, etc. For example, the I/O device can comprise a radio transceiver for transmitting wireless radio frequency (RF) signals to a remote receiver. Alternatively, or in addition to the transceiver, the I/O device can comprise an output port to which a pharmacist, for example, may connect a data transmission cable to download and/or upload pill timing information, and/or upload pill dosing information. Thus, the I/O device may be utilized by a party such as a pharmacist to determine if a patient is following a prescribed dosing schedule (i.e., is the patient dispensing the appropriate number of pills per dose and appropriate number of doses per day). The transceiver described above may be part of a passive or active Radio Frequency Identification ("RFID") chip, such as a Battery Assisted Passive ("BAP") tag, for example. Thus, communication with the I/O device may be performed wirelessly (e.g. RFID) or via a hardwired connection to the output port, for example. In one or more embodiments, the microprocessor encrypts the recorded pill timing information and/or the pill dosing information that is stored in memory. This encryption may be performed such that only an authorized party, such as a pharmacist, would be able to decrypt the data.

The controller circuit 6 can comprise software, hardware, or any combination thereof to implement these features, and those described below. The controller circuit 6 can comprise an Application Specific Integrated Circuit ("ASIC"), a Field Programmable Gate Array ("FPGA"), microprocessor/microcontroller, or any other type of processing circuit.

In one embodiment, the sensor array comprises one or more light-based sensors that are positioned and configured to detect whether a pill is present in the holding chamber 12 as a user manipulates the chamber layer 4 between the loading and dispensing positions. The light-based sensor may also be positioned such that it can sense the location of the holding chamber 12 as it is comes into alignment with the dispensing position. The first layer 3 and/or chamber layer 4 or portions thereof can comprise materials or coatings that are discernable by sensor (e.g. transparent plastic, reflective coating, barcode. The light sensor can be calibrated to detect a light change corresponding to a pill within the holding chamber 12 through first through hole 25, which could then be communicated to the microprocessor to indicate a pill is loaded. A second through hole 29 in the chamber layer 4 that is aligned with the second sensor 23 in the dispense position may be used to change an amount of light detected by the light sensor in the dispensing position, which could also be communicated to the microprocessor to indicate pill dispensing. Alternatively, or in addition to the light sensor, a magnet or proximity sensor could be used. Thus, in some embodiments and multiple sensors could be used.

The vertical side of the holding chamber 12 horizontally opposite the first sensor 22 may be open as in the diagrams of the embodiments herein. The open feature allows the user to be able to see if a pill is in the holding chamber 12 if the first layer 3 or portion of the first layer 3 is made of transparent or semi-transparent material.

A chamber back light 31 (not shown separately) may be incorporated into or near the first sensor 22 and activated by the controller circuit 6 to provide a visual aid for the user to be able to visually determine if a pill is present in the holding chamber 12 prior to depressing the chamber layer 4. The holding chamber 12 or portions thereof can comprise materials or coated to contrast with the color of pills to be dispensed. This color contrast may be applied to allow the user to visually determine if a pill is present in the holding chamber 12 prior to depressing the chamber layer 4.

The controller circuit 6 may maintain an internal digital clock with date and time values. This internal clock could be initiated by a manufacturer of the pill dispensing assembly 1, or by a pill dispensing entity such as a pharmacy. Software executed by the microprocessor could be used to monitor the electronic signal from sensor array to determine whether a pill is present in the holding chamber 12 at the load position and transition position and when the chamber layer 4 is aligned such that the holding chamber 12 is closely aligned with the dispense passage 11 indicating that a tablet is dispensed. Each of these events would trigger the software to save a value associated with the time and date stamp of the dispense operation into internal memory. This process is repeated for each pill dispensed for the pill dispensing assembly 1. The electronic components of the controller circuit 6 would then allow the contents of the memory to be downloaded for review in human readable form or for potential use by other computer systems.

The microprocessor may also be operatively connected to a notification device (e.g. led, vibration transducer, beeper) to provide a patient notification, such as the arrival of a dosage time, or a predefined amount of time passing after a suggested dosing time.

The microprocessor may also be operatively connected to an additional input device and a display (e.g., an LCD display and/or buttons, etc.) to allow the loader of tablets (e.g. a pharmacy) to store a pill dosing schedule in the memory. The input device can comprise a fingerprint sensor in communication with and/or comprised by controller circuit 6. The fingerprint sensor may be used for patient identification (e.g. to record a fingerprint of who is accessing the contents of a pill bottle). A fingerprint received via sensor may be compared to one or more saved fingerprints stored in memory. The memory may also store encrypted and/or unencrypted personal information about a patient, including some of the pill dosing information discussed above (e.g. a photo identification number or another personal identifier, pharmacy ID, pharmacist ID, etc.). The fingerprint sensor could be used simply to identify a patient and record a positive patient confirmation.

A power source (e.g. a battery) may be used to power the controller circuit 6 and all connected devices and electronic components as needed.

The display may be used to indicate dosing information to either a patient or caregiver (e.g., remaining time until next dose), or to a loader of tablets (e.g. an indicator of tampering or variance from the dosing schedule). For example, the display could display the time remaining until a subsequent dose and/or a time of a last dose. The controller circuit 6 and components may be located on the controller slot 30 or in other locations in the first layer 3 or chamber layer 4. The display can comprise a liquid crystal display (LCD), for example. Thus, the display may also be used as a notification device as described above.

Figures 4A, 4B, 4C:
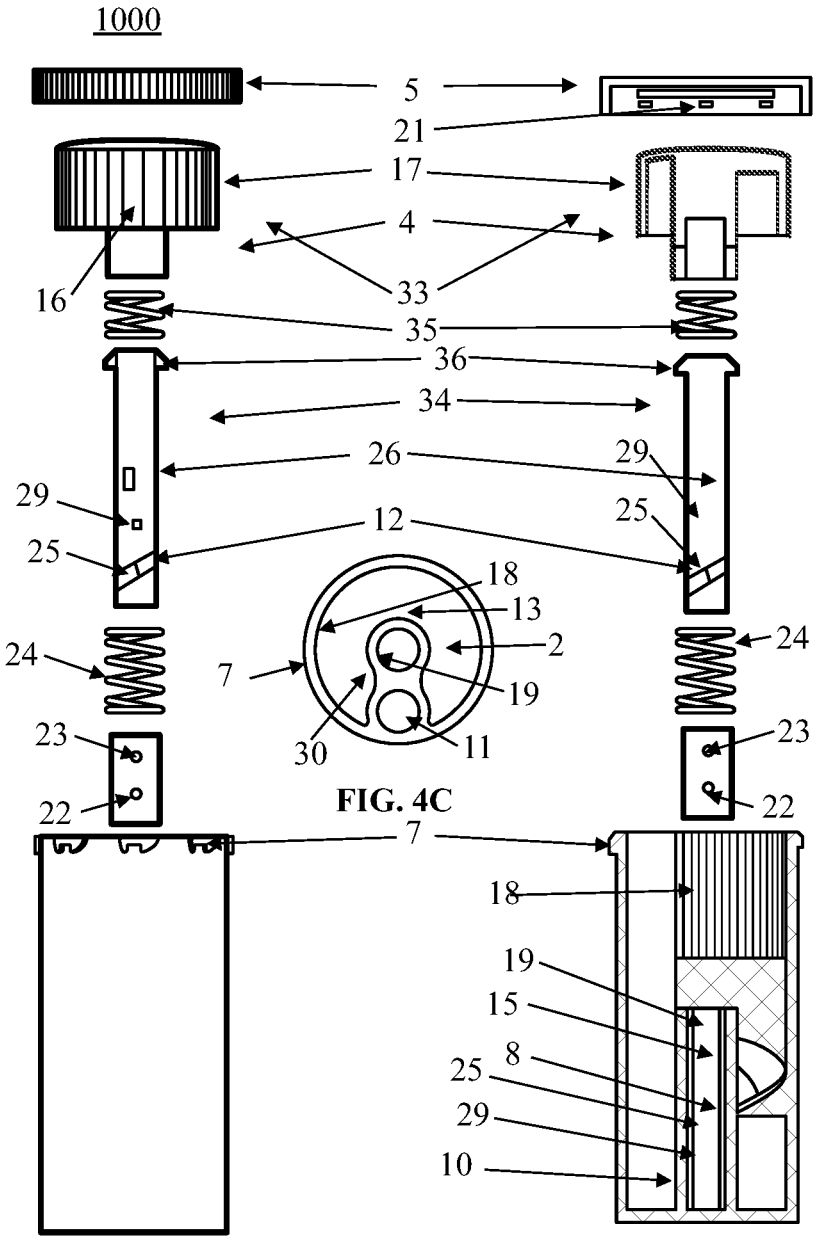
FIG. 4A illustrates an exploded view of a second example pill dispensing assembly for dispensing pills from a pill bottle containing an anti-pinch mechanism.
FIG. 4B illustrates another angle of an exploded view cut away of an second example pill dispensing assembly for dispensing pills from a pill bottle.
FIG. 4C illustrates an overhead view of the first layer of a second example pill dispensing assembly for dispensing pills from a pill bottle.
Figure 5A:
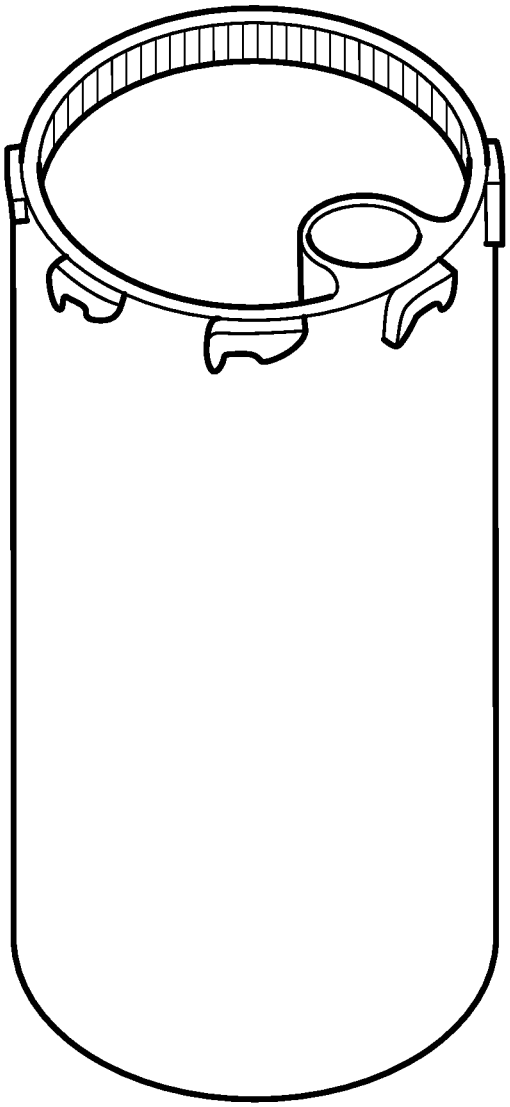
FIG. 5A illustrates an angled view of a second example pill dispensing assembly for dispensing pills from a pill bottle in the dispense position.
Figure 5B:
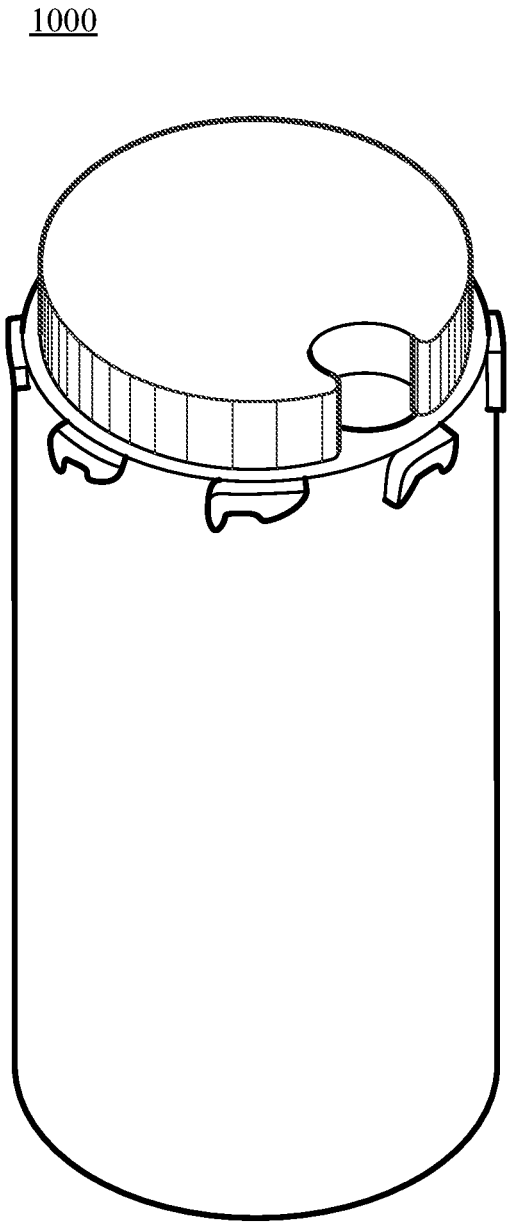
FIG. 5B illustrates an angled view of a second example pill dispensing assembly for dispensing pills from a pill bottle in the load position.
Figure 5C:
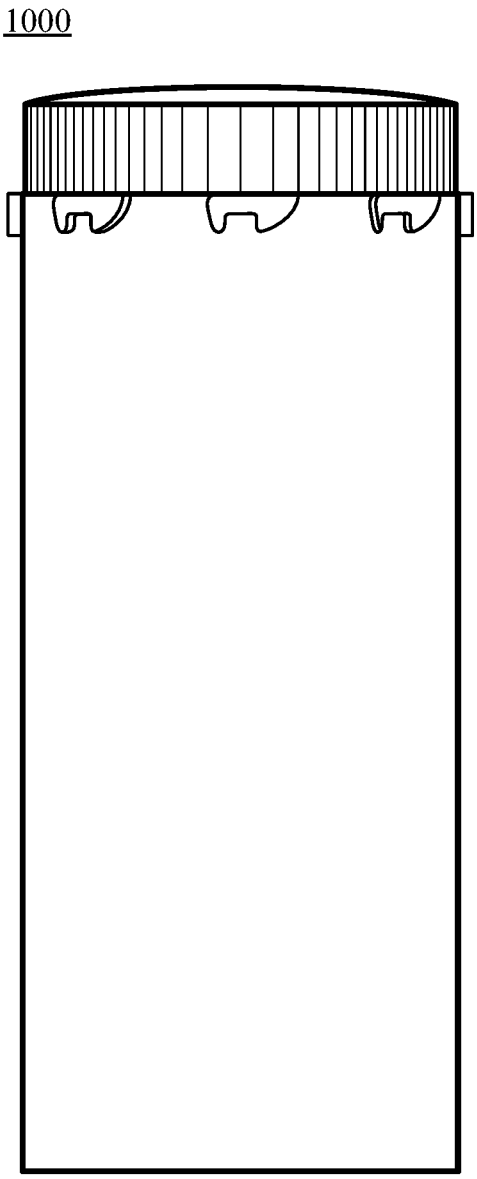
FIG. 5C illustrates an assembled side view of a second example pill dispensing assembly in the cap off position; also the load position.
Figure 5D:
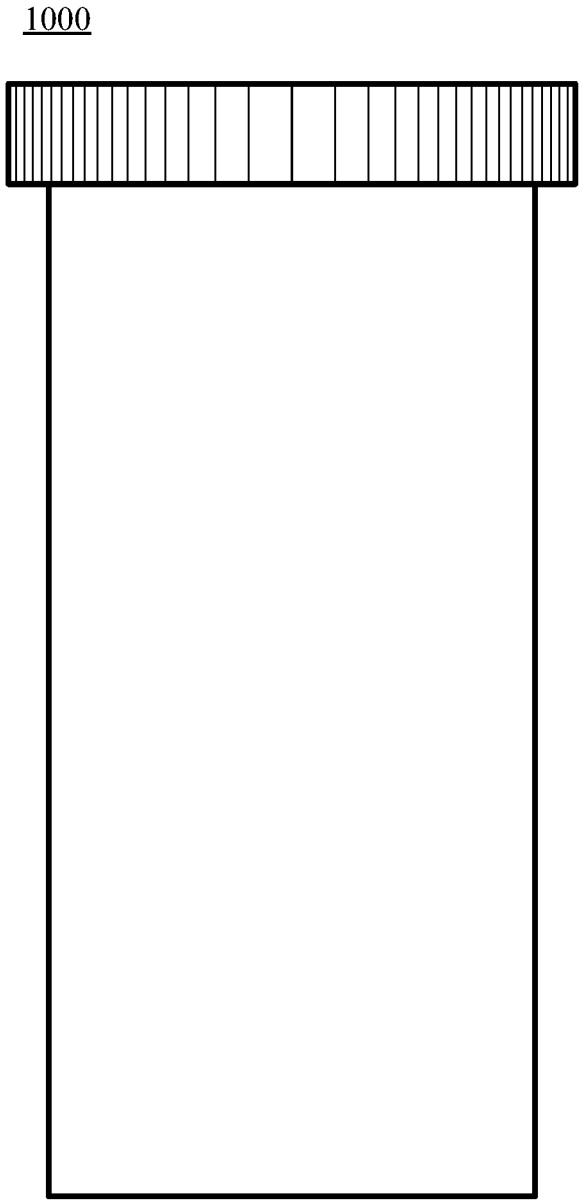
FIG. 5D illustrates an assembled side view of a second example pill dispensing assembly in the cap on position.
Figure 5E:
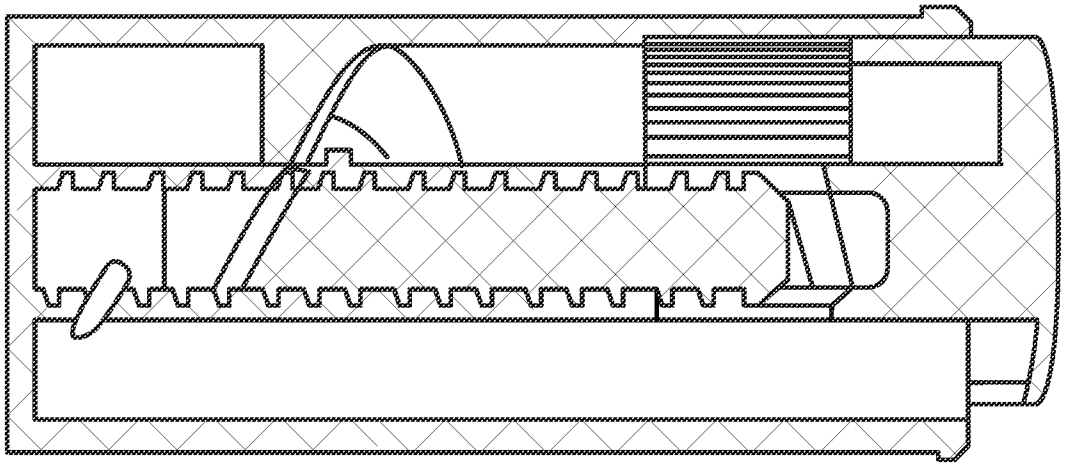
FIG. 5E illustrates an assembled side cut away view of a second example pill dispensing assembly for dispensing pills from a pill bottle at the load position.
Figure 5F:
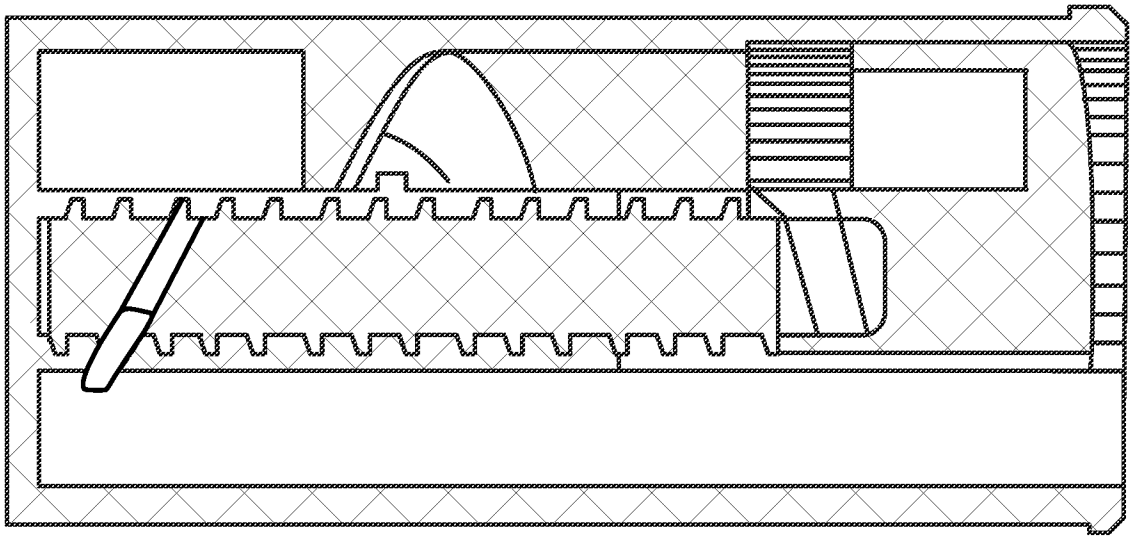
FIG. 5F illustrates an assembled side cut away view of a second example pill dispensing assembly for dispensing pills from a pill bottle at the dispense position.
Figure 5G:
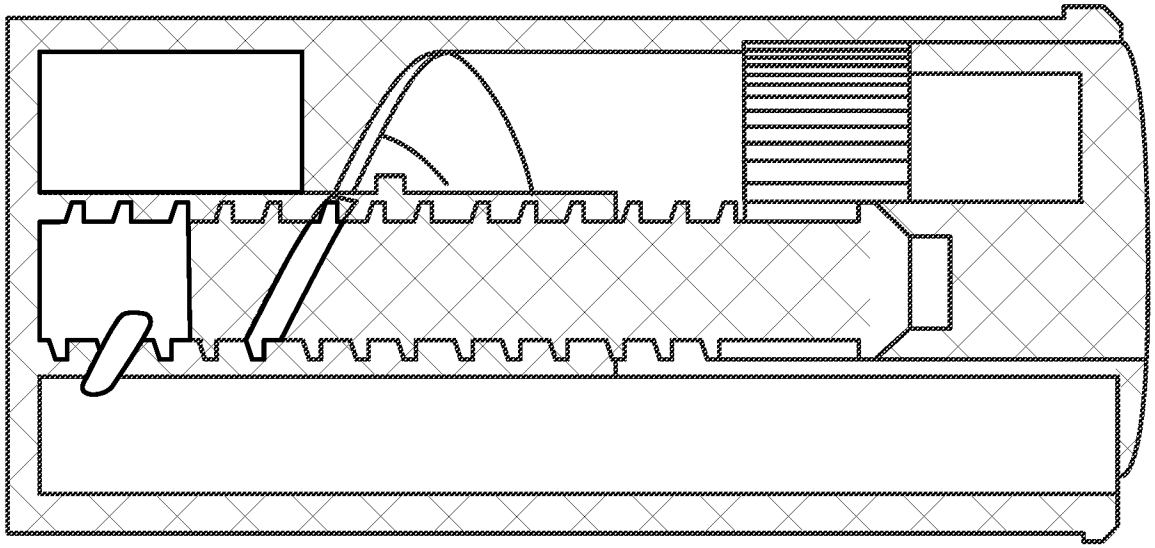
FIG. 5G illustrates an assembled side cut away view of a second example pill dispensing assembly for dispensing pills from a pill bottle in a table pinch orientation position.
Figure 6A:
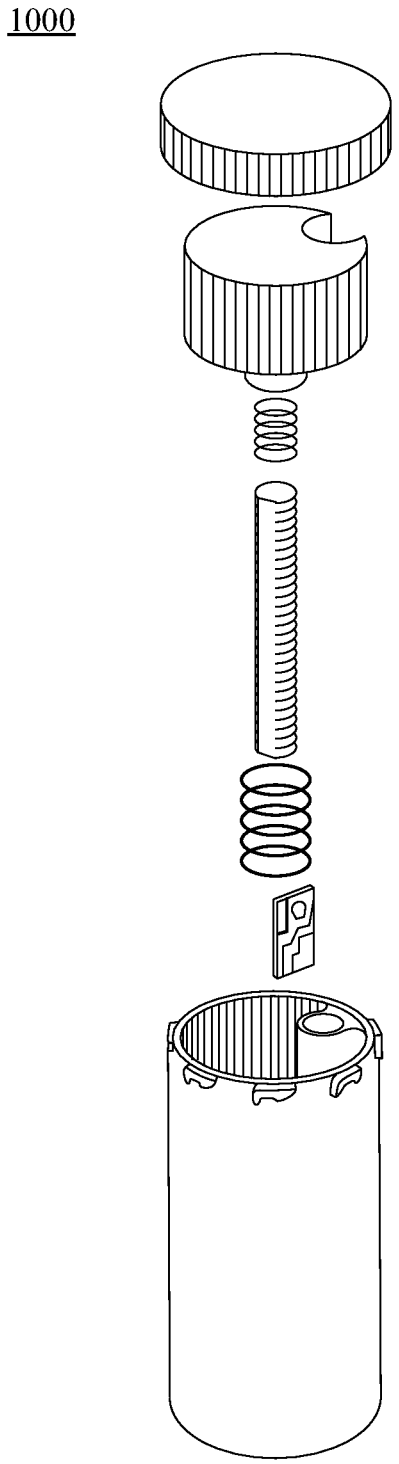
FIG. 6A illustrates an exploded angled view of a second example pill dispensing assembly for dispensing pills from a pill bottle.
Figure 6B:
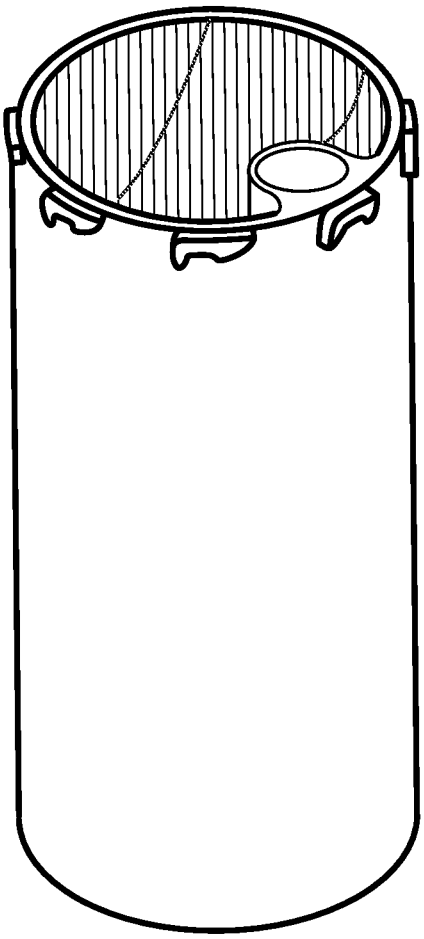
FIG. 6B illustrates an angled view of the first layer of a second example pill dispensing assembly for dispensing pills from a pill bottle.

A second embodiment is illustrated in FIG. 4A through FIG. 6B. FIG. 4A and FIG. 4B illustrates exploded views of an example second pill dispensing assembly 32. FIG. 4C illustrates a top view of the first layer 3. FIG. 5A through 6B provide additional views similar to that provided for the first example embodiment to further illustrate the second example embodiment. The basic elements of the second pill dispensing assembly 32 are the same or similar to that of the foregoing described first embodiment pill dispensing assembly 1 with the exception of the chamber layer 4 comprises a two-part chamber layer and a second bias member 35. The two-part chamber layer comprises a upper chamber portion 33 and a lower chamber portion 34 which are biased apart by the second bias member 35 which in this example is a coil spring but may be accomplished by other bias means (e.g. leaf spring).

In certain exemplary embodiments provide a device (i.e., pill dispensing assembly 1), which comprises:

- a pill reservoir 2;
- a first layer 3 that comprises an inclined entry passage 8 open to pill reservoir 2 and an exit passage 10 open to a dispense passage 11;
- a chamber layer 4 that comprises an upper chamber portion 33 and a lower chamber portion 34, wherein:
  - a part of upper chamber portion 33 of chamber layer 4 travels linearly in dose communication within a portion of first layer 3 and is biased apart linearly from the lower portion of the chamber layer by a second bias member 35;
  - lower chamber portion 34 of chamber layer 4 travels linearly and linearly in close communication with a portion of first layer 3 and is biased apart linearly from the upper portion of the chamber layer by second bias member 35, and comprises an inclined pill holding chamber 12 sized to receive a pill from the pill reservoir 2;
  - the lower portion of chamber layer 4 is biased by a first bias member 24 to the first loading position whereby pill holding chamber 12 is aligned with entry passage 8 of first layer 3 which is offset from exit passage 10 and where chamber layer 4 is linearly movable in opposition to first bias member 24 to a first dispense position whereby pill holding chamber 12 is aligned with the exit passage of first layer 3;

the upper portion of chamber layer 4 is constructed to move linearly and compress second bias member 35 allowing the lower portion of chamber layer 4 to remain linearly stationary with respect to first layer 3 in the event the lower portion of chamber layer 4 encounters an obstruction.

The upper and lower vertical travel range of the lower chamber portion 34 is controlled by a third catch 36 on the outside surface of the upper chamber portion 33 which operates within the vertical range offered by the vertical length of a third catch slot 37 extending outward from in the inside surface of the lower chamber portion 34. Other configurations of catches and slots or means to limit the travel of the chamber layers are possible (e.g. swapping the placement of catches and slots, multiple catches and slots).

The upper chamber portion 33 and the lower chamber portion 34 may travel linearly independent of one another to the extent that the second bias member 35 allows. The two-part chamber layer is held apart by second bias member 35 in this embodiment typically operates in vertical unison in a similar fashion as the one part chamber layer in the forgoing first embodiment unless the lower chamber portion 34 incurs an obstruction (e.g. binding table in the holding chamber 12). Upon depression of the upper chamber portion 33, such an obstruction would cause an upward linear force to be applied to the lower chamber portion 34 and if the upper chamber portion 33 is depressed linearly, the tension offered by the second bias member 35 is overcome causing compression of the second bias member 35 while allowing the lower chamber portion 34 to remain linearly stationary. This anti-chop feature prevents damage to the pills or the device.

Thus, the various embodiments of pill dispensing assemblies provide a number of benefits. One such benefit is providing the ability to monitor the dispensing of medication to users. Another benefit is to record pill dispensing data to provide pill providers and other interested parties (e.g. pharmacies and/or physicians, state governmental agencies and law enforcement) with information indicating whether patients adhere to prescribed dosing schedules. If this information is shared between pill providers and other interested parties, therein lie the ability to detect addictive and pre-addiction dosing patterns and to detect patterns of diversion, thereby allowing opportunities to take appropriate mitigating and preventive actions needed to address the opioid epidemic for example.

Unique features of can comprise but are not be limited to the below for a pill dispensing device:

Fully function within the dimensional parameters of a typical prescription bottle with only the need to attached a conventional child and/or moisture proof cap to make the assembly comply with regulatory requirements related to being moisture proof and childproof while having an outward appearance which is substantially the same or the same as a standard prescription bottle most commonly used by pharmacies.

Dispense operation involves pushing downward and releasing a linearly operated layer and inverting the pill dispensing device to deliver the pill external to the device.

A fully functional pill dispensing device that comprises a few as two mechanical components, a first bias member, a controller circuit and a typical child and/or moisture proof cap.

A chamber layer which is linearly mobile within close communication with a fixed layer and serves as the push button to operate the device between a load and dispense positions.

A chamber layer and first layer biased apart by a first bias member.

A holding chamber that is sloped and dimensioned to accept pills from a entry passage in a desire orientation; this orientation may be the pill laying on its long side or short side to facilitate entry as if a car tire on a road for example.

A fixed layer that contains a pill reservoir, guide features shaped with a bottom and sides to orient to guide pills into a linearly mobile holding chamber along a generally inclined slope.

A holding chamber shaped and dimensioned as a general continuation of slope of the holding chamber when in the load position.

A holding chamber shaped and dimensioned about the upper edge facing the entry passage to facilitate pushing pills that may be partially within the holding chamber back into the pill reservoir as the chamber layer is depressed from the load position (e.g. beveled upper edge of holding chamber).

A back light, visually contrasting chamber layer material or coating to aid in determining if a pill is in the holding chamber at the load position.

A linearly operated chamber layer which contains a pill holding chamber containing which is open to pill reservoir 2 via an entry passage 8 when aligned with entry passage 8 in the load position and is open to the dispense passage when aligned with exit passage 10 in the dispense position.

A pill dispensing device that comprises a linearly operated layer that comprises a pill holding chamber open on one side to facilitate visual inspection of whether pill is in holding chamber when in the load position.

A pill dispensing device that comprises a linearly operated layer that comprises a pill holding chamber open on one side to facilitate visual inspection of whether pill is in holding chamber when in the load position.

Holding chamber, outer bottle and/or chamber layer may be made of clear or semi clear material at area that provides a sight window to see the tablet in the holding chamber.

An array of one or more sensor(s) is positioned to detect positions of the chamber layer and presence of tablet in the holding chamber. An array of one or more detectable element(s) (e.g. hole, reflective surface, bar code) are positioned on or as part of the chamber layer such that one or more sensors can detect the presence of the tablet in the holding chamber at the load position and the tablet in the holding chamber when the holding chamber is between the load and dispense position.

A controller circuit configured to sense a pill in the holding chamber at the load position via sensor array and provide notification to the user of that detections via output device (e.g. sound transducer, wireless transceiver, fingerprint sensor, vibration element, LED light, LCD display, input buttons), to upload, store, view, convey and download prescription and dosing information (e.g. time each pill is dispensed, time between dosing, next scheduled dose time).

One or more sensors are positioned to detect when the holding chamber layer is in the fully up position and when the childproof cap is on and the chamber layer is partially depressed.

A first layer contains a tubular dispense passage that extends through chamber layer.

A chamber layer that is configured to be depressed by attachment of a child and/or moisture proof cap and that position detected by a controller circuit via sensor array.

A controller circuit with a sensor array positioned to sense a pill in the holding chamber and other distinguishingly detectable features of the chamber layer and/or first layer and configured to detect cap off: load position and dispense position.

A chamber layer and first layer may have segments of mating grooves at or near the interface of the holding chamber that prevent external access to sensor array.

A chamber layer and first layer may have segments of mating grooves at or near the interface of the top of the chamber layer that prevent external access to the pill reservoir or sensor array.

An overhanging element, which is part of the chamber layer and which extends into the pill reservoir area immediately over the entry passage. This feature helps prevent clogging of tablets at the chamber layer entry passage by removing pressure and congestion of pills upon the top surface of pills attempting to progress toward the entry passage.

A two-part chamber layer biased apart by a second bias member and where the lower part of the chamber layer contains a holding chamber and is configured with the first layer to allow vertical movement independent of the upper element of the chamber layer, thus preventing chopping of pills that may be caught across the junction between the first layer and chamber layer at the entry passage as the chamber layer is depress from the load position.

Figure 7:
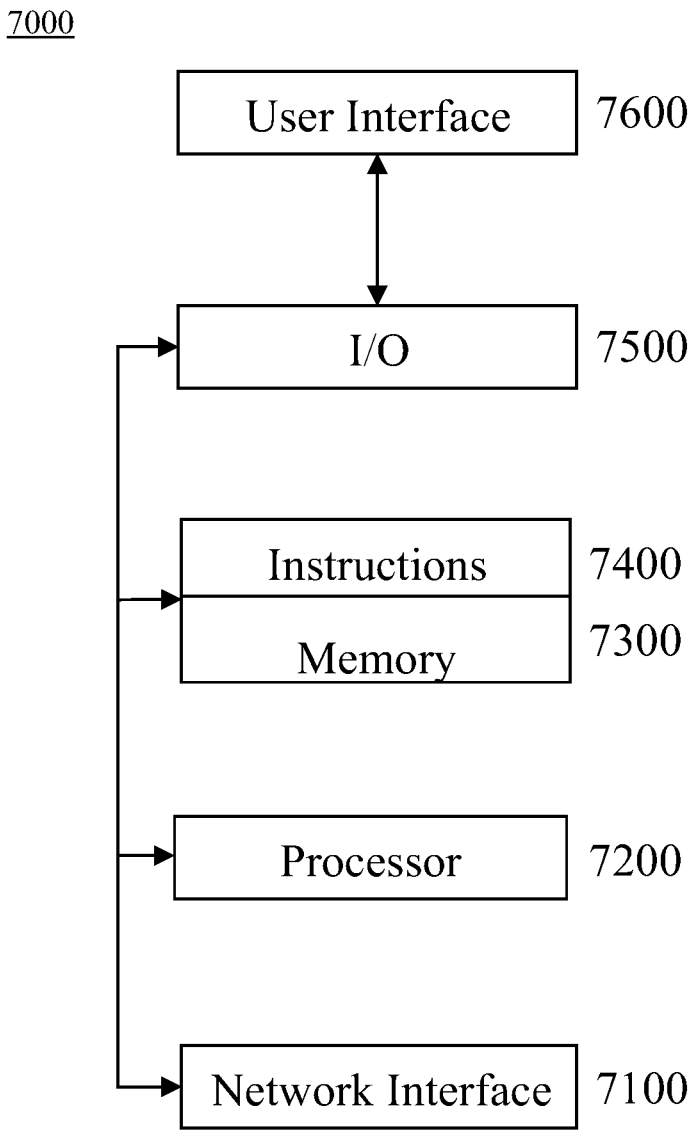
FIG. 7 is a block diagram of an exemplary embodiment of an information device 7000.

FIG. 7 is a block diagram of an exemplary embodiment of an information device 7000, which in certain operative embodiments can comprise, for example, controller circuit 6. Information device 7000 can comprise any of numerous circuits and/or components, such as for example, one or more network interfaces 7100, one or more processors 7200, one or more memories 7300 containing instructions 7400, one or more input/output (I/O) devices 7500, and/or one or more user interfaces 7600 coupled to one or more I/O devices 7500, etc.

In certain exemplary embodiments, via one or more user interfaces 2600, such as a graphical user interface, a user can view a rendering of information related to pill dispensing according to one or more exemplary embodiments.

Definitions

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

activity—an action, act, step, and/or process or portion thereof adapter—a device used to effect operative compatibility between different parts of one or more pieces of an apparatus or system.

align—to be substantially collinear with.

and/or—either in conjunction with or in alternative to.

apparatus—an appliance or device for a particular purpose associate—to join, connect together, and/or relate.

biased—held in position via a spring.

bias member—an elastic contrivance or body, as a strip or wire of steel coiled spirally, that recovers its shape after being compressed, bent, or stretched.

can—is capable of, in at least some embodiments.

cause—to produce an effect.

chamber—a compartment or cavity.

close communication—in proximity to such that surfaces are either touching or within a millimeter of touching.

comprising—including but not limited to.

configure—to make suitable or fit for a specific use or situation.

connect—to join or fasten together.

constructed to—made to and/or designed to.

controller—a device and/or set of machine-readable instructions for performing one or more predetermined tasks. A controller can comprise any one or a combination of hardware, firmware, and/or software. A controller can utilize mechanical, pneumatic, hydraulic, electrical, magnetic, optical, informational, chemical, and/or biological principles, signals, and/or inputs to perform the task(s). In certain embodiments, a controller can act upon information by manipulating, analyzing, modifying, converting, transmitting the information for use by an executable procedure and/or an information device, and/or routing the information to an output device. A controller can be a central processing unit, a local controller, a remote controller, parallel controllers, and/or distributed controllers, etc. The controller can be a general-purpose microcontroller, such the Pentium IV series of microprocessor manufactured by the Intel Corporation of Santa Clara, Calif. In another embodiment, the controller can be an Application Specific Integrated Circuit (ASIC) or a Field Programmable Gate Array (FPGA) that has been designed to implement in its hardware and/or firmware at least a part of an embodiment disclosed herein.

couple—to link in some fashion.

coupleable—capable of being joined, connected, and/or linked together.

create—to bring into being.

define—to establish the outline, form, or structure of determine—to obtain, calculate, decide, deduce, and/or ascertain.

device—a machine, manufacture, and/or collection thereof.

dispense—to give out or issue in portions.

encounter—to come into contact with.

entry—a way into a space.

exit—a way out of a space.

fixed—fastened, attached, and/or placed so as to be firm and not readily movable relative to another component.

hold—to contain something.

incline—a slope with respect to a horizontal plane.

information—data that has been organized to express concepts.

install—to connect or set in position and prepare for use.

layer—a quantity of material placed on the surface of something.

linearly—along a substantially straight line.

loading position—a location at which a chamber is aligned to receive a pill from a pill reservoir.

may—is allowed and/or permitted to, in at least some embodiments.
method—a process, procedure, and/or collection of related activities for accomplishing something.
movable—capable of being changed in position.
obstruction—something that blocks a path.
offset—not collinear with and, consequently, not allowing passage of a pill.
opposition—an action overcoming a resistance such as that of a spring.
passage—a corridor or pathway through something.
pill—a tablet or capsule, such as of medicine.
plurality—the state of being plural and/or more than one.
portion—a part of a whole.
position—location.
predetermined—established in advance.
prescription—an order for medicine.
project—to calculate, estimate, or predict.
receive—to get, take, acquire, and/or obtain.
record—to store a historical accounting.
related to—connected to and/or associated with.
repeatedly—again and again; repetitively.
request—to express a desire for and/or ask for.
reservoir—a receptacle or chamber constructed hold something.
set—a related plurality.
size—to have a sufficient diameter to pass a pill having a predetermined diameter.
stationary—in a substantially fixed position relative to something else.
store—to place, hold, and/or retain.
substantially—to a great extent or degree.
support—to bear the weight of, especially from below.
system—a collection of mechanisms, devices, machines, articles of manufacture, processes, data, and/or instructions, the collection designed to perform one or more specific functions.
timing—a determination of when something happens.
transmit—to send, provide, furnish, and/or supply.
travel—to move along a fixed path.
tubular shaped—having a contour of an elongate member having a longitudinal axis and defining a longitudinal cross-section resembling any closed shape such as, for example, a circle, a non-circle such as an oval (which generally can include a shape that is substantially in the form of an obround, ellipse, limacon, cardioid, cartesian oval, and/or Cassini oval, etc.), and/or a polygon such as a triangle, rectangle, square, hexagon, the shape of the letter "D", the shape of the letter "P", etc.
via—by way of and/or utilizing.
weight—a value indicative of importance.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;
no characteristic, function, activity, or element is "essential";
any elements can be integrated, segregated, and/or duplicated;
any activity can be repeated, any activity can be performed by multiple entities, and/or any activity can be performed in multiple jurisdictions; and
any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range comprises all values therein and all subranges therein. For example, if a range of 1 to 10 is described, that range comprises all values therebetween, such as for example, 1.1, 2.5, 3.335, 5, 6.179, 8.9999, etc., and comprises all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A device comprising:

a pill reservoir;
a first layer that comprises an inclined entry passage open to the pill reservoir and an exit passage open to a dispense passage;
a chamber layer whereby a portion of the chamber layer travels linearly in close communication within a tubular shaped portion of the first layer, and comprises an inclined pill holding chamber sized to receive a pill from the pill reservoir; wherein:
the chamber layer is biased by a first bias member to a first loading position whereby the pill holding chamber is aligned with the entry passage of the first layer which is offset from the exit passage; and
the chamber layer is linearly movable in opposition to the first bias member to a first dispense position whereby the pill holding chamber is aligned with the exit passage of the first layer; and a controller circuit constructed to detect if a pill is in the pill holding chamber.

2. The device of claim 1, further comprising:

a controller circuit constructed to record prescription information and timing information related to pill dispensing.

3. The device of claim 1, further comprising:

a controller circuit constructed to detect if a pill is in the pill holding chamber and record a timestamp denoting that the pill has been dispensed.

4. The device of claim 1, further comprising:

a controller circuit constructed to detect if a pill is in a transition position and thereby prevent a false recording of a dispensing operation when no pill was dispensed.

5. The device of claim 1, further comprising:

a controller circuit that comprises a microprocessor, memory, a sensor array, and an input/output ("I/O") device, wherein the microprocessor calculates and records in memory a time duration between pills.

6. The device of claim 1, further comprising:

a controller circuit that comprises an input/output device, the input/output device comprising a transceiver, wherein the input/output device uploads at least one of pill timing information and upload pill dosing information to a pharmacist.

7. The device of claim 1, further comprising:

a controller circuit that comprises a microprocessor, wherein the microprocessor encrypts at least one of recorded pill timing information and pill dosing information that is stored in a memory of the controller circuit.

8. The device of claim 1, further comprising:

a controller circuit that comprises a microprocessor, wherein the microprocessor is constructed to provide a patient notification of at least one of an arrival of a dosage time and a predefined amount of time passing after a suggested dosing time.

9. The device of claim 1, further comprising:

a controller circuit that comprises an input/output device, the input/output device comprising a fingerprint sensor, wherein the controller circuit is constructed to identify a patient and record a positive patient confirmation based upon a signal from the fingerprint sensor.

10. The device of claim 1, further comprising:

a childproof cap.

11. The device of claim 1, further comprising:

a moisture proof cap.

12. A device comprising:

a pill reservoir;

a first layer that comprises an inclined entry passage open to the pill reservoir and an exit passage open to a dispense passage;

a chamber layer that comprises an upper portion and a lower portion, wherein:

a portion of the upper portion of the chamber layer travels linearly in close communication within a portion of the first layer and is biased apart linearly from the lower portion of the chamber layer by a second bias member;

the lower portion of the chamber layer travels linearly and linearly in close communication with a portion of the first layer and is biased apart linearly from the upper portion of the chamber layer by the second bias member, and comprises an inclined pill holding chamber sized to receive a pill from the pill reservoir;

the lower portion of the chamber layer is biased by a first bias member to a first loading position whereby the pill holding chamber is aligned with the entry, passage of the first layer which is offset from the exit passage and where the chamber layer is linearly movable in opposition to the first bias member to a first dispense position whereby the pill holding chamber is aligned with the exit passage of the first layer;

the upper portion of the chamber layer is constructed to move linearly and compress the second bias member allowing the lower portion of the chamber layer to remain linearly stationary with respect to the first layer in event that the lower portion of the chamber layer encounters an obstruction.

* * * * *